US007040245B1

(12) United States Patent
Nash

(10) Patent No.: US 7,040,245 B1
(45) Date of Patent: May 9, 2006

(54) HINGE ASSEMBLY FOR A HATCH COVER OF A WATERCRAFT

(75) Inventor: Chester Colburn Nash, Fayetteville, GA (US)

(73) Assignee: Yamaha Motor Manufacturing Corporation of America, Newnan, GA (US)

( * ) Notice: Subject to any disclaimer, the term of this patent is extended or adjusted under 35 U.S.C. 154(b) by 0 days.

(21) Appl. No.: 10/973,135

(22) Filed: Oct. 26, 2004

(51) Int. Cl.
*B63B 19/12* (2006.01)

(52) U.S. Cl. ..... 114/201 R; 16/289; 16/306; 49/386

(58) Field of Classification Search ..... 114/55.53, 114/201 R; 49/386, 246, 248, 250; 16/289, 16/306, 366, 367, 368; 296/76
See application file for complete search history.

(56) References Cited

U.S. PATENT DOCUMENTS 2,626,421 A * 1/1953 Lyons ..... 16/306
3,209,392 A * 10/1965 Levine ..... 16/289
5,419,012 A * 5/1995 Lewis ..... 16/306
6,308,650 B1 10/2001 Tsumiyama et al.
6,401,299 B1 * 6/2002 Schwarz ..... 296/76

FOREIGN PATENT DOCUMENTS

JP 6-42259 2/1994

* cited by examiner

*Primary Examiner*—Lars A. Olson
(74) *Attorney, Agent, or Firm*—Keating & Bennett, LLP

(57) ABSTRACT

A hinge assembly for a hatch cover of a watercraft includes a hinge arm having a substantially J-shaped configuration and made of an extruded material, a deck mounting bracket for connecting the hinge arm to a deck of the watercraft, a hatch cover mounting bracket for connecting the hinge arm to a hatch cover of the watercraft, a hinge shaft connecting the hinge arm to the deck mounting bracket, and at least one mounting member connecting the hinge arm to the hatch cover mounting bracket. The hinge arm has a width dimension extending in a longitudinal direction of the hinge shaft that is greater than a thickness dimension extending in a direction perpendicular to the longitudinal direction of the hinge shaft.

44 Claims, 7 Drawing Sheets

HINGE ASSEMBLY FOR A HATCH COVER OF A WATERCRAFT

BACKGROUND OF THE INVENTION

1. Field of the Invention

The present invention relates to a hinge assembly for a hatch cover of a watercraft. More specifically, the present invention relates to a hinge assembly for a hatch cover of a watercraft which provides a simplified structure for accurately and securely positioning the hatch cover with respect to the hull of the watercraft.

2. Description of the Related Art

U.S. Pat. No. 6,308,650 discloses a conventional hinge assembly H for a watercraft which includes a complicated double action mechanism through which a hatch cover 50 is openable around a hinge shaft 1*a* which moves apart from an upper surface F of the deck 100 as the hatch cover 50 is opened. As seen in FIGS. 3, 4 and 7–9 of U.S. Pat. No. 6,308,605, the structure and configuration of the hinge assembly H is very complicated and requires a very large number of parts.

Particularly, the hinge assembly H of U.S. Pat. No. 6,308,650 includes an attaching member 5 which is secured to the hatch cover 50. Link members 4A–4C are connected between the attaching member 5 and a gear frame 2 which is attached to the deck 100 of the watercraft.

In addition, a shock absorber 6 is connected between the attaching member 5 and the gear frame 2 so as to damp the movement of the hatch cover 50. The link members 4A and 4B are connected to the gear frame 2 via support shafts 3*a* and 3*b*, the link member 4C is connected to the link member 4B via a connecting pin 1*b*, and link members 4A and 4C are connected to the attaching member 5 via connecting pins 1*a* and 1*c*.

Gears 3A and 3B are connected to the support shafts 3*a* and 3*b* and are disposed within the gear frame 2 so as to provide a firmly structured hinge assembly between the hatch cover 50 and the deck 100.

However, with the structure disclosed in U.S. Pat. No. 6,308,650, the structure of the hinge assembly H is very complicated and includes a large number of parts, and the hinge assembly H occupies a large amount of space within the hatch of the watercraft.

SUMMARY OF THE INVENTION

To overcome the problems described above, preferred embodiments of the present invention provide a hinge assembly for a watercraft having a simplified construction which accurately and securely supports the hatch cover on the deck of the watercraft and occupies much less space within the hatch of the watercraft as compared to the hinge assembly according to the prior art.

According to a preferred embodiment of the present invention, a hinge assembly for a hatch cover of a watercraft includes an extruded hinge arm having a substantially J-shaped configuration, a deck mounting bracket for connecting the hinge arm to a deck of the watercraft, a hatch cover mounting bracket for connecting the hinge arm to a hatch cover of the watercraft, a hinge shaft connecting the extruded hinge arm to the deck mounting bracket, and at least one mounting member connecting the hinge arm to the hatch cover mounting bracket. The hinge arm has a width dimension extending in a longitudinal direction of the hinge shaft that is greater than a thickness dimension extending in a direction perpendicular to the longitudinal direction of the hinge shaft.

In the hinge assembly according to the present preferred embodiment of the present invention, the hinge arm is preferably defined by a single unitary member.

In the hinge assembly according to a preferred embodiment of the present invention, the hinge arm preferably includes at least one hole provided at each of two end portions thereof, such that the hinge shaft extends through the at least one hole provided at one of the end portions and the at least one mounting member extends through the at least one hole provided at the other of the two end portions.

In the hinge assembly according to a preferred embodiment of the present invention, the deck mounting bracket preferably includes a base portion for attaching the deck mounting bracket to the deck of the watercraft, and includes two side portions extending substantially perpendicular to the base portion. The two side portions are spaced from one another such that the hinge arm is disposed between the side portions.

In the hinge assembly according to a preferred embodiment of the present invention, each of the side portions of the deck mounting bracket preferably includes at least one hole disposed therein, such that the hinge shaft extends through the at least one hole in each of the side portions and through the one of the at least one hole provided at the one end portion of the hinge arm.

In the hinge assembly according to a preferred embodiment of the present invention, the deck mounting bracket preferably further includes a cylindrical member disposed between the side portions, and the hinge arm further includes a hook member for engaging with the cylindrical member when the hatch cover is in an open position so as to maintain the hatch cover in the open position.

In the hinge assembly according to a preferred embodiment of the present invention, the cylindrical member is preferably made of rubber.

In the hinge assembly according to a preferred embodiment of the present invention, the cylindrical member is preferably fixed between the side portions of the deck mounting bracket by a pin that extends through a central passage provided in the cylindrical member and through holes provided in the side portions.

The hinge assembly according to a preferred embodiment of the present invention preferably further includes a biasing member disposed around the hinge shaft. The biasing member includes a first arm in contact with the hinge arm and a second arm in contact with the deck mounting bracket for biasing the hatch cover of the watercraft into an open position.

In the hinge assembly according to the preferred embodiment of the present invention, the biasing member is preferably defined by a coil spring, and the first and second arms are defined by ends of the coil spring.

Other features, elements, characteristics and advantages of the present invention will become more apparent from the following detailed description of preferred embodiments of the present invention with reference to the attached drawings.

DETAILED DESCRIPTION OF PREFERRED EMBODIMENTS

FIGS. 1–8 illustrate preferred embodiments of the present invention.

Figure 1:
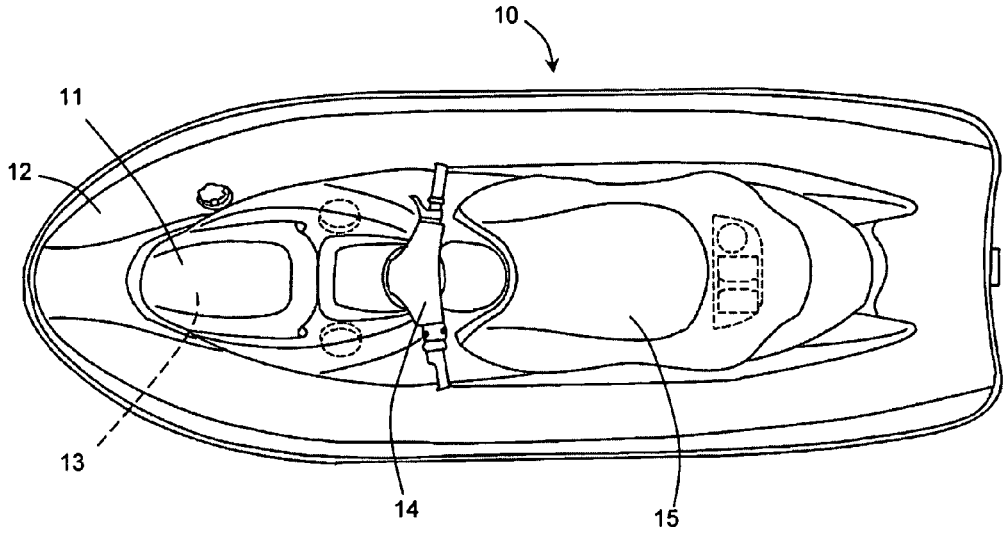
FIG. 1 is a top view of a watercraft in which a hinge assembly according to a preferred embodiment of the present invention is provided.

As seen in FIG. 1, in the watercraft 10 according to a preferred embodiment of the present invention, a hatch cover 11 is attached to a deck 12 of the watercraft 10 via a hinge assembly 20, which will be described in detail below, so as to cover a storage space 13. Preferably, the storage space 13 is located in the bow of the watercraft 10 in front of the steering assembly 14 and the seat area 15.

A personal watercraft 10 is shown in FIG. 1. However, it should be noted that the hatch cover 11 and hinge assembly 20, which will be described below, is suitable for use in any type of watercraft, such as a motorboat and a jet boat.

Figure 2:
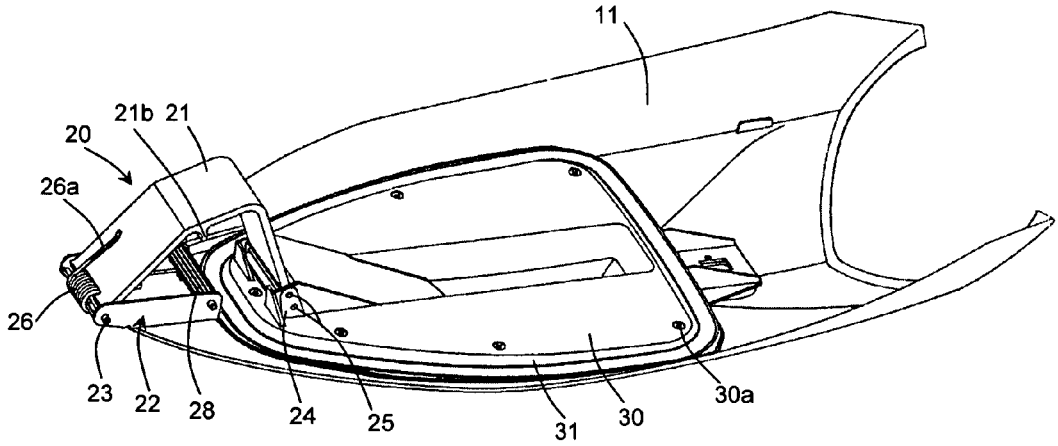
FIG. 2 is a view of a hatch cover including the hinge assembly according to a preferred embodiment of a present invention.

FIG. 2 shows the underside of the hatch cover 11. As seen in FIG. 2, a hinge assembly 20 is connected to the hatch cover 11 such that the hatch cover 11 can be moved from a closed position to an open position.

The hinge assembly 20 includes a hinge arm 21 having a substantially J-shaped configuration, a deck mounting bracket 22 connected to the deck 12, a hinge shaft 23 which connects one end of the hinge arm 21 to the deck mounting bracket 22, a hatch cover mounting bracket 24 connected to the hatch cover 11, and mounting bolts 25 which connect the hinge arm 21 to the hatch cover mounting bracket 24. It should be noted that a mounting pin or a mounting axial member or other suitable member or assembly may be used in place of the mounting bolts 25 to connect the hinge arm 21 to the hatch cover mounting bracket 24.

Figure 3:
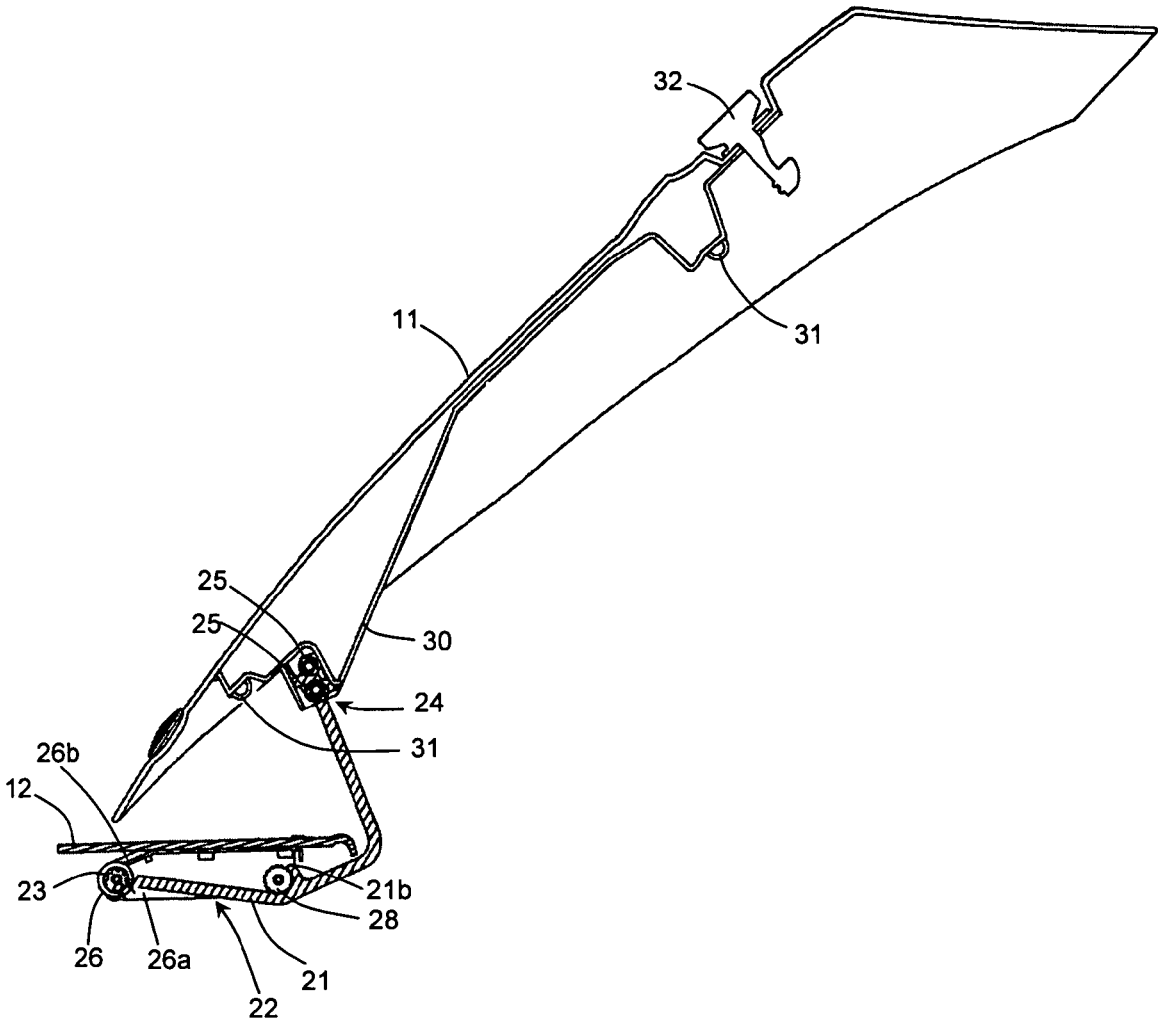
FIG. 3 is a side view of the hatch cover and hinge assembly according to a preferred embodiment of the present invention in an open position.
Figure 4:
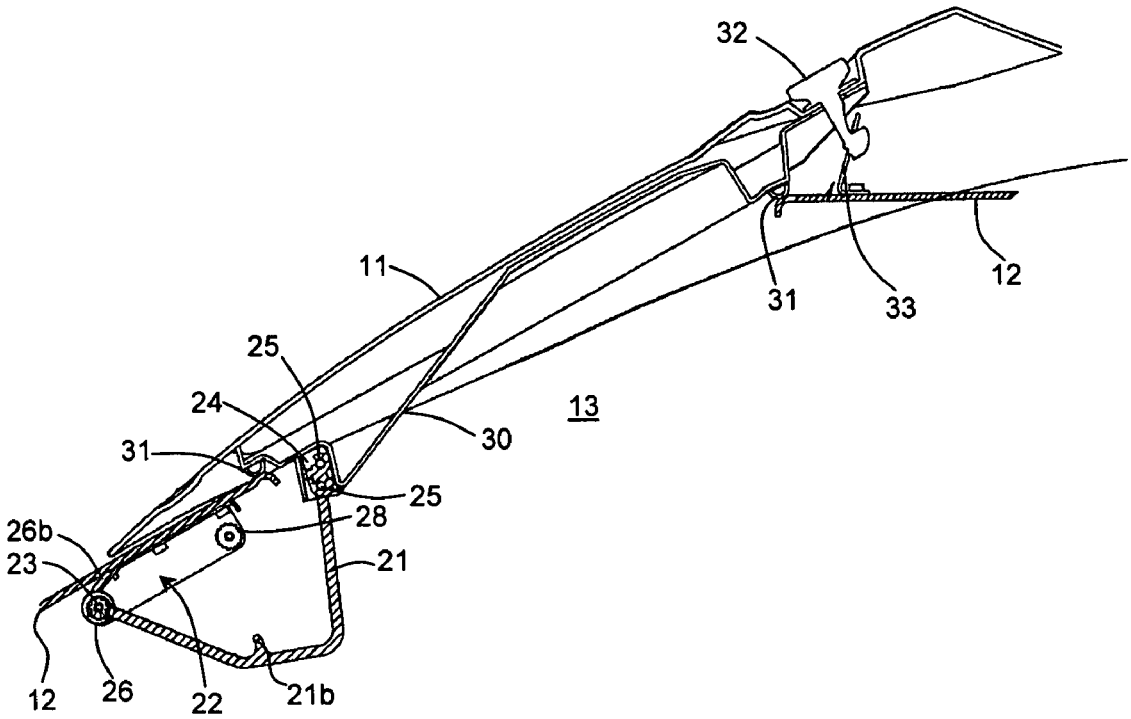
FIG. 4 is a side view of the hatch cover and hinge assembly according to a preferred embodiment of the present invention in a closed position.
Figure 5:
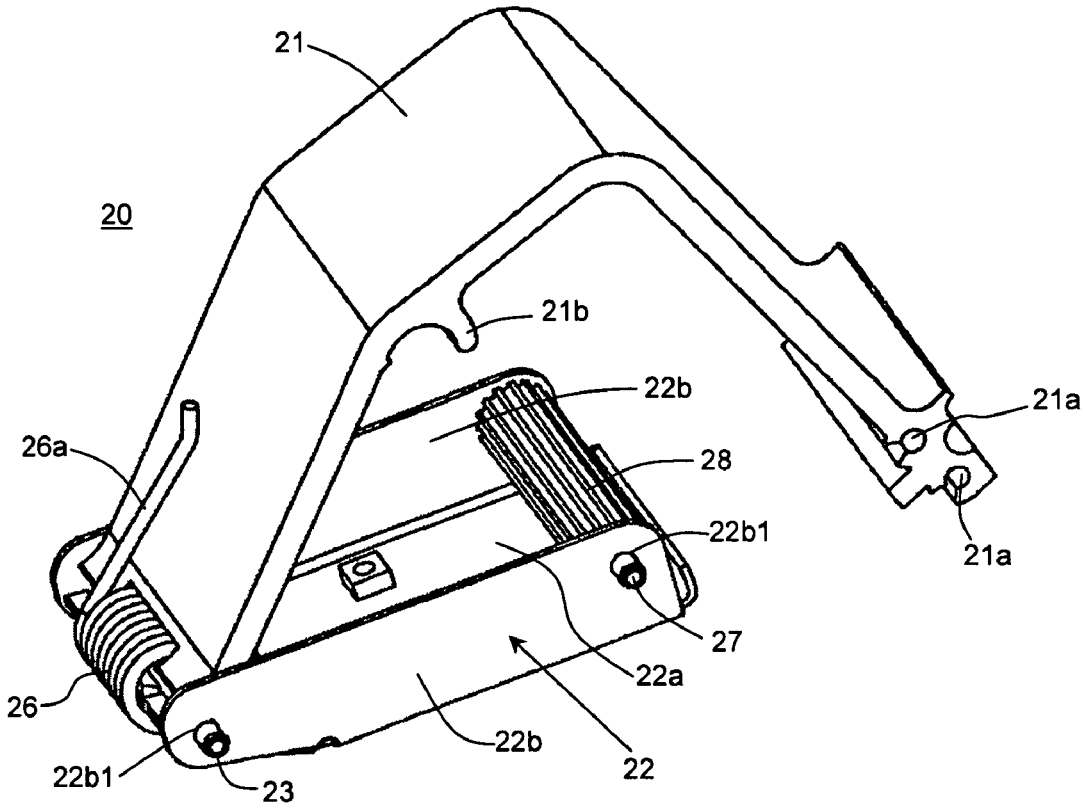
FIG. 5 is a plan view of the hinge assembly according to a preferred embodiment of the present invention.
Figure 6:
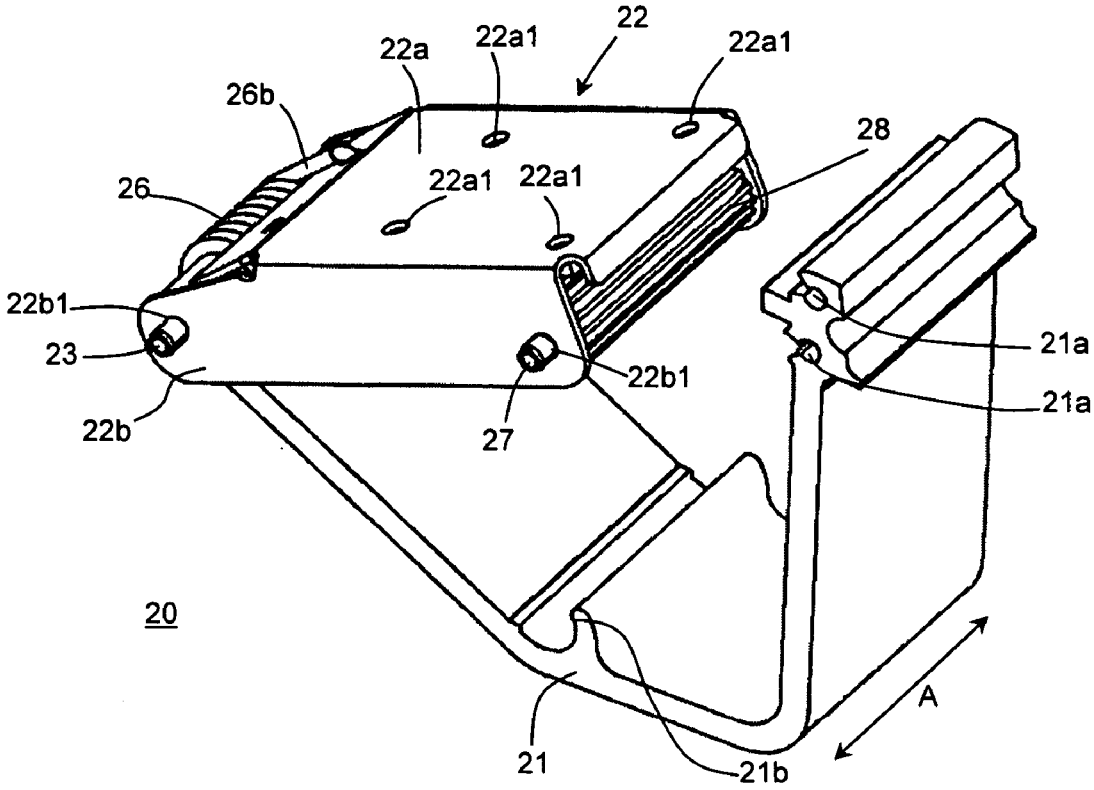
FIG. 6 is another plan view of the hinge assembly according to a preferred embodiment of the present invention.

As shown in FIGS. 5 and 6, the hinge arm 21 includes through holes 21*a* at each end thereof, through which the hinge shaft 23 and the mounting bolts 25 extend, as seen in FIGS. 2–4. The hinge arm 21 is preferably made of an extruded material by an extrusion process, and the through holes 21*a* therein are formed in the hinge arm 21 as the hinge arm 21 is extruded in the extrusion process. The hinge arm 21 according to the present preferred embodiment is preferably made of extruded aluminum. However, the hinge arm 21 may be made of any suitable extruded metal material.

In the extrusion process, the hinge arm 21 is extruded in the direction A, as shown in FIG. 6. The direction A is the direction in which the hinge shaft 23 extends. By extruding the hinge arm 21 in the direction A, the strength of the hinge arm 21 is greatly increased and the hinge arm 21 is manufactured with greatly improved accuracy. The hinge arm 21 has a width dimension in the direction A that is greater than a thickness dimension extending in a direction that is perpendicular to the direction A. As a result, the hinge arm 21 reliably and securely holds the hatch cover 11, especially when the hatch cover 11 is in the open position, such that there is no or very little movement of the hatch cover 11 laterally.

A biasing member 26 is disposed around the hinge shaft 23 and includes an arm 26*a*, as shown in FIGS. 2 and 5, which is in contact with the hinge arm 21, and includes an arm 26*b*, as shown in FIG. 6, which is in contact with the deck mounting bracket 22 so as to bias the hinge arm 21 and the hatch cover 11 towards an open position. In the present preferred embodiment of the present invention, the biasing member is preferably a coil spring. However, other suitable biasing members may be used.

As seen in FIG. 5, the deck mounting bracket 22 preferably has a substantially U-shaped configuration including a base portion 22*a* which is in contact with the deck 12 when the deck mounting plate 22 is mounted to the deck 12 and two side portions 22*b* extending substantially perpendicular to the base portion 22*a* and away from the deck 12. The base portion 22*a* includes holes 22*a*1, as seen in FIG. 6, through which fastening members (not shown) extend for attaching the deck mounting bracket 22 to the deck 12. The fastening members may be any suitable fastening members, such as screws or rivets. As seen in FIGS. 5 and 6, the two side portions 22*b* include holes 22*b*1 through which the hinge shaft 23 and a mounting pin 27 extend. It should be noted that a mounting bolt or a mounting axial member or other suitable member or assembly may be used in place of the mounting pin 27. The side portions 22*b* of the deck mounting bracket are spaced apart from one another such that the hinge arm 21 fits between the side portions 22*b*.

As shown in FIGS. 2–7, a cylindrical member 28 is disposed between the two side portions 22*b* of the deck mounting bracket 22 such that the mounting pin 27 extends through a passage in the cylindrical member 28 so as to rotatably support the cylindrical member 28 with respect to the deck mounting member 22. The cylindrical member 28 is preferably made of a resilient material, such as rubber or any other suitable resilient material.

Figure 7:
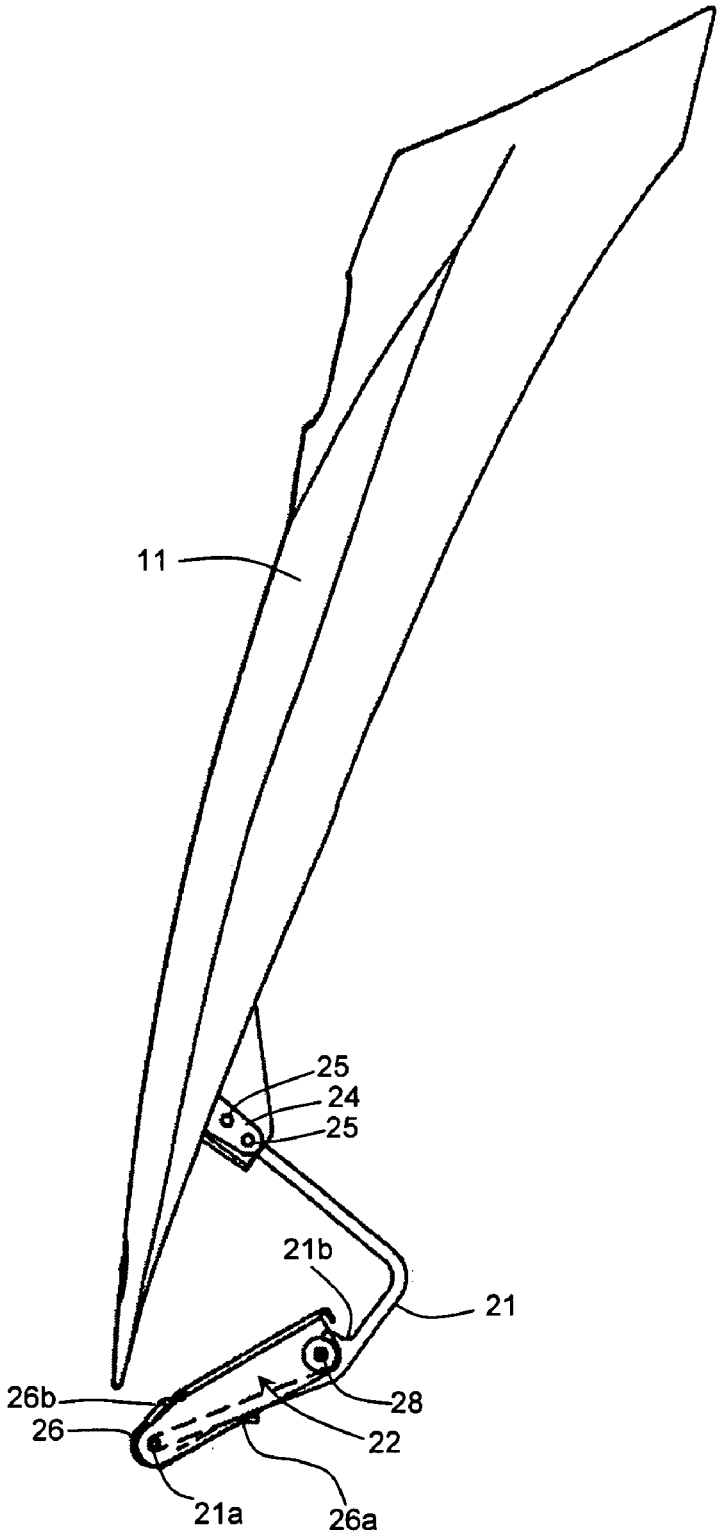
FIG. 7 is another side view of the hatch cover and hinge assembly according to a preferred embodiment of the present invention in an open position.

The hinge arm 21 includes a hook member 21*b* which engages the cylindrical member 28 when the hatch cover 11 is in the open position so as to maintain the hatch cover 11 in the open position, as seen in FIGS. 3 and 7.

As shown in FIGS. 2–4, the hatch cover 11 includes a ventilator cover 30 that is mounted to an inner surface of the hatch cover 11 through fastening members 30*a*, such as rivets, for example. The hatch cover mounting bracket 24 is provided at a front portion of the ventilator cover 30.

The hatch cover 11 further includes a sealing member 31 disposed around the periphery of the ventilator cover 30. As shown in FIG. 4, the sealing member 31 is arranged to contact with the deck portion when the hatch cover 11 is in the closed position so as to prevent water from entering the storage space 13. The sealing member 31 is preferably made of rubber. However, the sealing member 31 may be made of any suitable sealing material.

As shown in FIG. 4, at a rear portion of the hatch cover 11, a latch 32 is provided. When the hatch cover 11 is in the closed position, the latch 32 engages with a latch hook 33 so as to maintain the hatch cover 11 in the closed position and to prevent the hatch cover 11 from inadvertently opening when the watercraft 10 is in operation.

Figure 8:
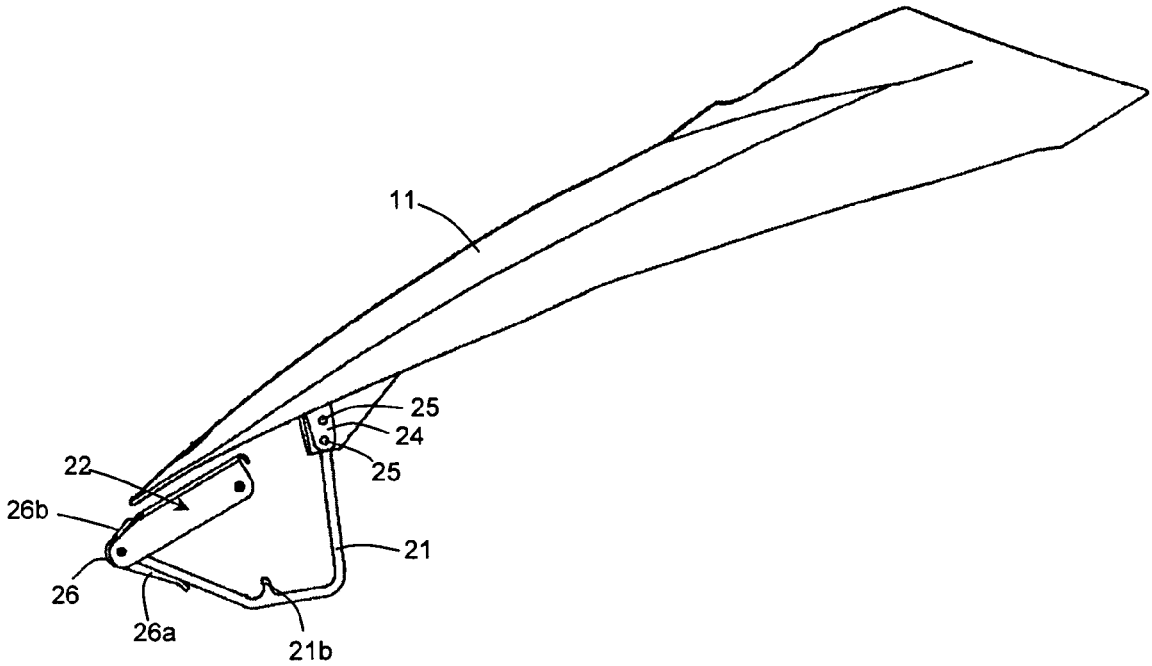
FIG. 8 is another side view of the hatch cover and hinge assembly according to a preferred embodiment of the present invention in a closed position.

With the hinge assembly 20 according to the preferred embodiment of the present invention including the features described above and which is connected to the deck 12 via deck mounting bracket 22 and to the hatch cover 11 via the hatch cover mounting bracket 24, the hatch cover is easily moved between the closed position as shown in FIGS. 4 and 8 and the open position as shown in FIGS. 3 and 7.

In particular, when the latch 32 is released from the latch hook 33, the biasing member 26 biases the hatch cover 11 upward from the closed position as shown in FIGS. 4 and 8 to the open position as shown in FIGS. 3 and 7 such that the hook 21*b* of the hinge arm 21 is engaged with the cylindrical member 28 so as to maintain the hatch cover 11 in the open position. When it is desired to close the hatch cover 11, an operator merely applies downward pressure to the hatch cover 11 against the biasing force of the biasing member 26 which easily disengages the hook 21*b* of the hinge arm 21 from the cylindrical member 28. The downward pressure is maintained until the latch 32 is engaged with the latch hook 33 so as to maintain the hatch cover 11 in the closed position.

With the unique structure of the preferred embodiments described above, a hinge assembly of a hatch cover has a much simpler and less expensive structure that reliably and securely attaches the hatch cover to a watercraft. Also, the simplified construction of the hinge assembly which accurately and securely supports the hatch cover on the deck of the watercraft occupies much less space within the hatch of the watercraft as compared to the hinge assembly according to the prior art, and allows the hinge assembly to be located at a front-most portion of a deck of the hull of the watercraft. In addition, the simple design and fewer required parts of the hinge assembly of the hatch cover structure allows the hinge assembly to be manufactured and assembled much more easily and for much less cost as compared to prior art devices.

While the present invention has been described with respect to preferred embodiments thereof, it will be apparent to those skilled in the art that the disclosed invention may be modified in numerous ways and may assume many embodiments other than those specifically set out and described above. Accordingly, it is intended that the appended claims cover all modifications of the present invention which fall within the true spirit and scope of the present invention.

What is claimed is:

1. A hinge assembly for a hatch cover of a watercraft comprising:

a hinge arm having a substantially J-shaped configuration and being made of an extruded material;

a deck mounting bracket for connecting the hinge arm to a deck of the watercraft;

a hatch cover mounting bracket for connecting the hinge arm to a hatch cover of the watercraft;

a hinge shaft connecting the hinge arm to the deck mounting bracket; and at least one mounting member connecting the hinge arm to the hatch cover mounting bracket; wherein the hinge arm has a width dimension extending in a longitudinal direction of the hinge shaft that is greater than a thickness dimension extending in a direction perpendicular to the longitudinal direction of the hinge shaft.

2. The hinge assembly according to claim 1, wherein the hinge arm is defined by a single unitary member.

3. The hinge assembly according to claim 1, wherein the hinge arm includes at least one hole provided at each of two end portions thereof, such that the hinge shaft extends through the at least one hole provided at one of the end portions and the at least one mounting member extends through the at least one hole provided at the other of the two end portions.

4. The hinge assembly according to claim 3, wherein the deck mounting bracket includes a base portion for attaching the deck mounting bracket to the deck of the watercraft and two side portions extending substantially perpendicular to the base portion, the two side portions being spaced from one another such that the hinge arm is disposed between the side portions.

5. The hinge assembly according to claim 4, wherein each of the side portions of the deck mounting bracket includes at least one hole disposed therein, such that the hinge shaft extends through the at least one hole in each of the side portions and through the one of the at least one hole provided at the one end portion of the hinge arm.

6. The hinge assembly according to claim 4, wherein the deck mounting bracket further includes a cylindrical member disposed between the side portions, and the hinge arm further includes a hook member for engaging with the cylindrical member when the hatch cover is in an open position so as to maintain the hatch cover in the open position.

7. The hinge assembly according to claim 6, wherein the cylindrical member is made of rubber.

8. The hinge assembly according to claim 6, wherein the cylindrical member is fixed between the side portions of the deck mounting bracket by a mounting member that extends through a central passage provided in the cylindrical member and through holes provided in the side portions.

9. The hinge assembly according to claim 1, further comprising a biasing member disposed around the hinge shaft and having a first arm in contact with the hinge arm and a second arm in contact with the deck mounting bracket for biasing the hatch cover of the watercraft into an open position.

10. The hinge assembly according to claim 9, wherein the biasing member is defined by a coil spring, and the first and second arms are defined by ends of the coil spring.

11. The hinge assembly according to claim 1, wherein the at least one mounting member includes one of a mounting bolt, a mounting pin and a mounting axial member.

12. A method of mounting a hinge assembly for a watercraft, the method comprising the steps of:

providing a deck mounting bracket;

providing a hatch cover mounting bracket;

providing a hinge shaft;

providing at least one mounting member;

extruding a hinge arm having a substantially J-shaped configuration;

connecting the hinge arm to the deck mounting bracket via the hinge shaft; and connecting the hinge arm to the hatch cover mounting bracket via the at least one mounting member; wherein the hinge arm is extruded such that the hinge arm has a width dimension extending in a longitudinal direction of the hinge shaft that is greater than a thickness dimension extending in a direction perpendicular to the longitudinal direction of the hinge shaft, and the hinge arm is extruded in the width dimension thereof.

13. The method according to claim 12, wherein the hinge arm is extruded such that the hinge arm is defined by a single unitary member having a substantially constant width dimension-along the entire hinge arm.

14. The method according to claim 12, wherein in the extruding step, the hinge arm is extruded so as to include at least one hole provided at each of two end portions thereof, such that in the step of connecting the hinge arm to the deck mounting bracket, the hinge shaft extends through one of the at least one hole provided at one of the end portions, and such that in the step of connecting the hinge arm to the hatch cover mounting bracket, the at least one mounting member extends through the at least one hole provided at the other of the two end portions.

15. The method according to claim 14, wherein in the step of providing a deck mounting bracket, the deck mounting bracket is provided with a base portion for attaching the deck mounting bracket to the deck of the watercraft and two side portions extending perpendicular to the base portion, the two side portions being spaced from one another such that the hinge arm is disposed between the side portions in the step of connecting the hinge arm to the deck mounting bracket.

16. The method according to claim 15, wherein each of the side portions of the deck mounting bracket includes at least one hole disposed therein, such that the hinge shaft extends through the at least one hole in each of the side portions and through the one of the at least one hole provided at the one end portion of the hinge arm.

17. The method according to claim 15, further comprising the step of providing a cylindrical member between the side portions of the deck mounting bracket, and in the extruding step, the hinge arm is extruded with a hook member for engaging with the cylindrical member when the hatch cover is in an open position so as to maintain the hatch cover in the open position.

18. The method according to claim 17, wherein the cylindrical member is made of rubber.

19. The method according to claim 17, wherein the step of providing the cylindrical member includes the step of fixing the cylindrical member between the side portions of the deck mounting bracket by a mounting member that extends through a central passage provided in the cylindrical member and through holes provided in the side portions.

20. The method according to claim 12, further comprising the step of providing a biasing member disposed around the hinge shaft and having a first arm in contact with the hinge arm and a second arm in contact with the deck mounting bracket for biasing the hatch cover of the watercraft into an open position.

21. The method according to claim 20, wherein the biasing member is defined by a coil spring, and the first and second arms are defined by ends of the coil spring.

22. The method according to claim 12, wherein the at least one mounting member includes one of a mounting bolt, a mounting pin and a mounting axial member.

23. A hinge assembly for a hatch cover of a watercraft comprising:

a hinge arm;

a deck mounting bracket for connecting the hinge arm to a deck of the watercraft;

a hatch cover mounting bracket for connecting the hinge arm to a hatch cover of the watercraft;

a hinge shaft connecting the hinge arm to the deck mounting bracket; and at least one mounting member connecting the hinge arm to the hatch cover mounting bracket; wherein the hinge arm is movable between a first position in which a portion of the hinge arm is spaced below and away from the deck mounting bracket and a second position in which said portion of the hinge arm is located within the deck mounting bracket, wherein the first position of the hinge arm corresponds to a position in which the hatch cover is closed and the second position of the hinge arm corresponds to a position in which the hatch cover is open.

24. The hinge assembly according to claim 23, wherein the hinge arm is defined by a single unitary member.

25. The hinge assembly according to claim 23, wherein the hinge arm includes at least one hole provided at each of two end portions thereof, such that the hinge shaft extends through the at least one hole provided at one of the end portions and the at least one mounting member extends through the at least one hole provided at the other of the two end portions.

26. The hinge assembly according to claim 25, wherein the deck mounting bracket includes a base portion for attaching the deck mounting bracket to the deck of the watercraft and two side portions extending substantially perpendicular to the base portion, the two side portions being spaced from one another such that the hinge arm is disposed between the side portions.

27. The hinge assembly according to claim 26, wherein each of the side portions of the deck mounting bracket includes at least one hole disposed therein, such that the hinge shaft extends through the at least one hole in each of the side portions and through the one of the at least one hole provided at the one end portion of the hinge arm.

28. The hinge assembly according to claim 26, wherein the deck mounting bracket further includes a cylindrical member disposed between the side portions, and the hinge arm further includes a hook member for engaging with the cylindrical member when the hatch cover is in an open position so as to maintain the hatch cover in the open position.

29. The hinge assembly according to claim 28, wherein the cylindrical member is made of rubber.

30. The hinge assembly according to claim 28, wherein the cylindrical member is fixed between the side portions of the deck mounting bracket by a mounting member that extends through a central passage provided in the cylindrical member and through holes provided in the side portions.

31. The hinge assembly according to claim 23, further comprising a biasing member disposed around the hinge shaft and having a first arm in contact with the hinge arm and a second arm in contact with the deck mounting bracket for biasing the hatch cover of the watercraft into an open position.

32. The hinge assembly according to claim 31, wherein the biasing member is defined by a coil spring, and the first and second arms are defined by ends of the coil spring.

33. The hinge assembly according to claim 23, wherein the at least one mounting member includes one of a mounting bolt, a mounting pin and a mounting axial member.

34. A hinge assembly for a hatch cover of a watercraft comprising:

a hinge arm having a first mating member;

a deck mounting bracket for connecting the hinge arm to a deck of the watercraft, the deck mounting bracket having a second mating member;

a hatch cover mounting bracket for connecting the hinge arm to a hatch cover of the watercraft;

a hinge shaft connecting the hinge arm to the deck mounting bracket; and at least one mounting member connecting the hinge arm to the hatch cover mounting bracket; wherein the hinge arm is movable between a first position in which the first and second mating members are spaced from each other and a second position in which the first and second mating members are engaged with each other.

35. The hinge assembly according to claim 34, wherein the hinge arm is defined by a single unitary member.

36. The hinge assembly according to claim 34, wherein the hinge arm includes at least one hole provided at each of two end portions thereof, such that the hinge shaft extends through the at least one hole provided at one of the end portions and the at least one mounting member extends through the at least one hole provided at the other of the two end portions.

37. The hinge assembly according to claim 36, wherein the deck mounting bracket includes a base portion for attaching the deck mounting bracket to the deck of the watercraft and two side portions extending substantially perpendicular to the base portion, the two side portions being spaced from one another such that the hinge arm is disposed between the side portions.

38. The hinge assembly according to claim 37, wherein each of the side portions of the deck mounting bracket includes at least one hole disposed therein, such that the hinge shaft extends through the at least one hole in each of the side portions and through the one of the at least one hole provided at the one end portion of the hinge arm.

39. The hinge assembly according to claim 37, wherein the first mating member of the hinge arm is a hook member and the second mating member of the deck mounting bracket is a cylindrical member disposed between the side portions, the hook member engages with the cylindrical member when the hatch cover is in the second position so as to maintain the hatch cover in the second position, and the second position corresponds to an open position of the hatch cover.

40. The hinge assembly according to claim 39, wherein the cylindrical member is made of rubber.

41. The hinge assembly according to claim 39, wherein the cylindrical member is fixed between the side portions of the deck mounting bracket by a mounting member that extends through a central passage provided in the cylindrical member and through holes provided in the side portions.

42. The hinge assembly according to claim 34, further comprising a biasing member disposed around the hinge shaft and having a first arm in contact with the hinge arm and a second arm in contact with the deck mounting bracket for biasing the hatch cover of the watercraft into an open position.

43. The hinge assembly according to claim 42, wherein the biasing member is defined by a coil spring, and the first and second arms are defined by ends of the coil spring.

44. The hinge assembly according to claim 34, wherein the at least one mounting member includes one of a mounting bolt, a mounting pin and a mounting axial member.

* * * * *